US010699635B2

(12) United States Patent
Chen et al.

(10) Patent No.: US 10,699,635 B2
(45) Date of Patent: Jun. 30, 2020

(54) POWER MANAGEMENT DEVICE, POWER MANAGEMENT METHOD, AND PIXEL CIRCUIT

(71) Applicant: Novatek Microelectronics Corp., Hsinchu (TW)

(72) Inventors: Ko-Fang Chen, Hsinchu (TW); Huang-Chin Tang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 218 days.

(21) Appl. No.: 16/045,757

(22) Filed: Jul. 26, 2018

(65) Prior Publication Data

US 2020/0035160 A1 Jan. 30, 2020

(51) Int. Cl.
*G09G 3/3233* (2016.01)

(52) U.S. Cl.
CPC ..... *G09G 3/3233* (2013.01); *G09G 2320/046* (2013.01); *G09G 2330/021* (2013.01)

(58) Field of Classification Search
CPC ..... G09G 3/32–3291
See application file for complete search history.

(56) References Cited

U.S. PATENT DOCUMENTS

2002/0180671 A1* 12/2002 Inukai ..... G09G 3/2011 345/76
2003/0107565 A1* 6/2003 Libsch ..... G09G 3/3233 345/211
2004/0012336 A1* 1/2004 Okuda ..... G09G 3/3216 315/169.1
2007/0257865 A1* 11/2007 Bajk ..... G09G 3/32 345/75.2
2009/0284519 A1* 11/2009 Kim ..... G09G 3/3233 345/213
2010/0109540 A1* 5/2010 Kim ..... G09G 3/3225 315/210
2013/0044047 A1* 2/2013 Tomida ..... G09G 3/3233 345/76
2015/0170569 A1* 6/2015 Han ..... G09G 3/3258 345/78
2017/0154581 A1* 6/2017 Chen ..... G09G 3/2018
2019/0129565 A1* 5/2019 Hwang ..... G06F 3/0416

* cited by examiner

*Primary Examiner* — Patrick F Marinelli
(74) *Attorney, Agent, or Firm* — JCIPRNET

(57) ABSTRACT

A power management device including a power management circuit is provided. The power management circuit is configured to output a first power signal and a second power signal to a pixel circuit of a display panel. The pixel circuit includes an organic light-emitting diode. The organic light-emitting diode includes an anode terminal and a cathode terminal. The anode terminal is coupled to the first power signal. The cathode terminal is coupled to the second power signal. The second power signal is an alternating-current voltage. In addition, a pixel circuit of a display panel, and a power management method for the pixel circuit of the display panel are also provided.

12 Claims, 4 Drawing Sheets

POWER MANAGEMENT DEVICE, POWER MANAGEMENT METHOD, AND PIXEL CIRCUIT

BACKGROUND

Technical Field

The invention generally relates to an electrical circuit, a pixel circuit of a display panel, and a management method for the pixel circuit of the display panel. More particularly, the invention relates to a power management circuit, a pixel circuit of a display panel, and a power management method for the pixel circuit of the display panel.

Description of Related Art

Display panels, and especially organic light-emitting diode (OLED) displays, are applied widely in the real-life applications and electronic devices. OLED displays have advantages on energy efficiency, thinness, high contrast ratio and overall display quality. Typically, an OLED display includes a plurality of OLEDs that are integrated with thin-film transistors (TFT) to form an OLED pixel arrays. However, OLED displays have disadvantages such as the burn-in issue. Burn-in is a form of image retention that lasts much longer on the display panel. Burn-in is usually visible even when the display panel plays other image content. It's usually caused by leaving a static image the display panel for a long period of time. In addition, as the resolution increases, the power consumption of the OLED displays also increases, especially when the OLED displays display images of high brightness.

Therefore, it would be desirable to remedy the influences of the burn-in to a display apparatus, thereby improving quality of the display apparatus and improving user experience in using the display apparatus.

SUMMARY

A power management circuit, a pixel circuit of a display panel, and a power management method for the pixel circuit of the display panel are introduced to remedy the burn-in issue in the display panel. In addition, a display apparatus including the power management circuit has low power consumption.

The invention provides a power management device including a power management circuit. The power management circuit is configured to output a first power signal and a second power signal to a pixel circuit of a display panel. The pixel circuit includes an organic light-emitting diode. The organic light-emitting diode includes an anode terminal and a cathode terminal. The anode terminal is coupled to the first power signal. The cathode terminal is coupled to the second power signal. The second power signal is an alternating-current voltage.

In an embodiment of the invention, levels of the second power signal are adjusted according to a control signal.

In an embodiment of the invention, the levels of the second power signal includes a first level and a second level. The first level and the second level are respectively determined according to a reference voltage, a first voltage and a second voltage. The first level is higher than the second level.

In an embodiment of the invention, the power management circuit includes a first switch, a second switch and a capacitor. The first switch includes a first end, a second end and a control end. The first end of the first switch is coupled to the first voltage. The control end of the first switch is coupled to the control signal. The second switch includes a first end, a second end and a control end. The first end of the second switch is coupled to the second voltage. The control end of the second switch is coupled to a reverse signal of the control signal. The capacitor includes a first end and a second end. The first end of the capacitor is coupled to the second end of the first switch and the second end of the second switch. The second end of the capacitor is coupled to the reference voltage. The power management circuit outputs the second power signal via the second end of the capacitor.

In an embodiment of the invention, the power management circuit further includes an inverter. The inverter includes an input end and an output end. The input end of the inverter receives the control signal. The output end of the inverter outputs the reverse signal of the control signal.

In an embodiment of the invention, the control signal is a digital signal. When the first switch is conducted, the second switch is not conducted. When the second switch is conducted, the first switch is not conducted.

In an embodiment of the invention, the power management circuit receives the control signal from a display driver device. The display driver device outputs a scan signal and a data signal to the pixel circuit and outputs the control signal to the power management circuit.

In an embodiment of the invention, the first power signal is a direct-current voltage.

The invention provides a pixel circuit of a display panel. The pixel circuit includes: a first transistor, a second transistor, an organic light-emitting diode and a capacitor. The first transistor includes a first end, a second end and a control end. The first end of the first transistor is coupled to a data line. The control end of the first transistor is coupled to a scan line. The second transistor includes a first end, a second end and a control end. The first end of the second transistor is coupled to a first power signal. The control end of the second transistor is coupled to the second end of the first transistor. The organic light-emitting diode includes an anode terminal and a cathode terminal. The anode terminal is coupled to the second end of the second transistor. The cathode terminal is coupled to the second power signal. The capacitor includes a first end and a second end. The first end of the capacitor is coupled to the first end of the second transistor. The second end of the capacitor is coupled to the control end of the second transistor. The second power signal is an alternating-current voltage.

In an embodiment of the invention, levels of the second power signal are adjusted according to a control signal.

In an embodiment of the invention, the levels of the second power signal includes a first level and a second level. The first level and the second level are respectively determined according to a reference voltage, a first voltage and a second voltage. The first level is higher than the second level.

In an embodiment of the invention, the first power signal is a direct-current voltage.

The invention provides a power management method for a pixel circuit of a display panel. The pixel circuit includes an organic light-emitting diode. The organic light-emitting diode includes an anode terminal and a cathode terminal. The power management method includes: outputting a first power signal to the anode terminal of the organic light-emitting diode; and adjusting levels of a second power signal according to a control signal, and outputting the second power signal to the cathode terminal of the organic light-emitting diode. The second power signal is an alternating-current voltage.

In an embodiment of the invention, the power management method further includes: receiving the control signal from a display driver device. The display driver device outputs a scan signal and a data signal to the pixel circuit.

In an embodiment of the invention, the levels of the second power signal includes a first level and a second level. The first level is higher than the second level. The power management method further includes: respectively determining the first level and the second level according to a reference voltage, a first voltage and a second voltage.

In an embodiment of the invention, the first power signal is a direct-current voltage.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
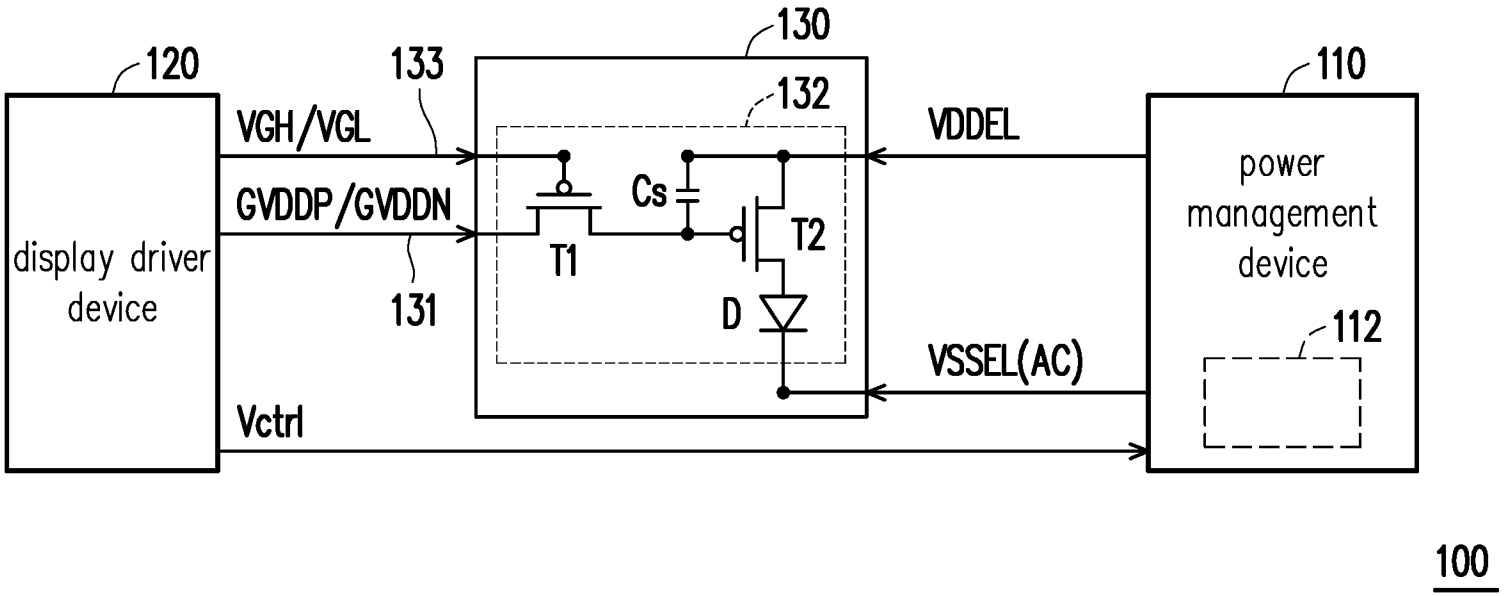
FIG. 1 illustrates a schematic diagram of a display apparatus according to an embodiment of the invention.

FIG. 1 illustrates a schematic diagram of a display apparatus according to an embodiment of the invention. Referring to FIG. 1, the display apparatus 100 of the present embodiment includes a power management device 110, a display driver device 120 and a display panel 130. The power management device 110 includes power management circuit. The display panel 130 includes a pixel circuit 132. For the sake of brief explanation, only one pixel circuit is shown in the display panel 130, but the number of the pixel circuit 132 does not intend to limit the invention.

In the present embodiment, the pixel circuit 132 includes a first transistor T1, a second transistor T2, an organic light-emitting diode D and a capacitor Cs. The first transistor T1 includes a first end, a second end and a control end. The first end of the first transistor T1 is coupled to a data line 131. The second end of the first transistor T1 is coupled to a control end of the second transistor T2. The control end of the first transistor T1 is coupled to a scan line 333. The display driver device 120 outputs scan signals VGH/VGL to the control end of the first transistor T1 via the scan line 133, so as to control the conduction state of the first transistor T1. The display driver device 120 outputs data signals GVDDP/GVDDN to the first end of the first transistor T1 via the data line 131, so as to write display data to the pixel circuit 132.

In the present embodiment, the pixel circuit may be implemented by using structures of any pixel circuits in the related art, which are not particularly limited by the invention. Enough teaching, suggestion, and implementation illustration for aforesaid pixel circuit and embodiments thereof may be obtained with reference to common knowledge in the related art, which is not repeated hereinafter.

The second transistor T2 includes a first end, a second end and a control end. The first end of the second transistor T2 is coupled to a first power signal VDDEL. The second end of the second transistor T2 is coupled to an anode terminal of the organic light-emitting diode. The control end of the second transistor T2 is coupled to the second end of the first transistor T1. The organic light-emitting diode D includes an anode terminal and a cathode terminal. The anode terminal is coupled to the second end of the second transistor T2. The cathode terminal is coupled to the second power signal VSSEL(AC). The capacitor Cs includes a first end and a second end. The first end of the capacitor Cs is coupled to the first end of the second transistor T2. The second end of the capacitor Cs is coupled to the control end of the second transistor T2.

In the present embodiment, the power management circuit 112 outputs the first power signal VDDEL and the second power signal VSSEL(AC) to the pixel circuit 132. The first power signal VDDEL is a direct-current (DC) positive voltage. The second power signal VSSEL(AC) is an alternating-current (AC) voltage. In the present embodiment, the display driver device 120 outputs a control signal Vctrl to the power management circuit 112, and levels of the second power signal VSSEL(AC) are adjusted according to the control signal Vctrl.

Figure 2:
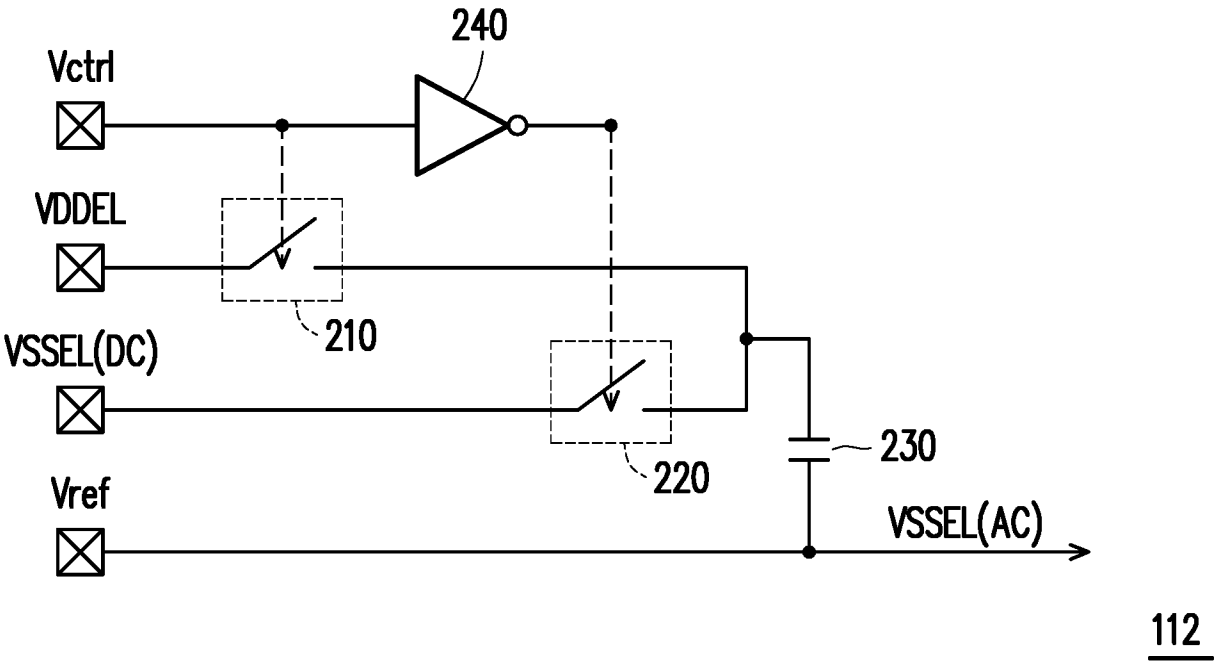
FIG. 2 illustrates a schematic diagram of the power management circuit depicted in FIG. 1.
Figure 3:
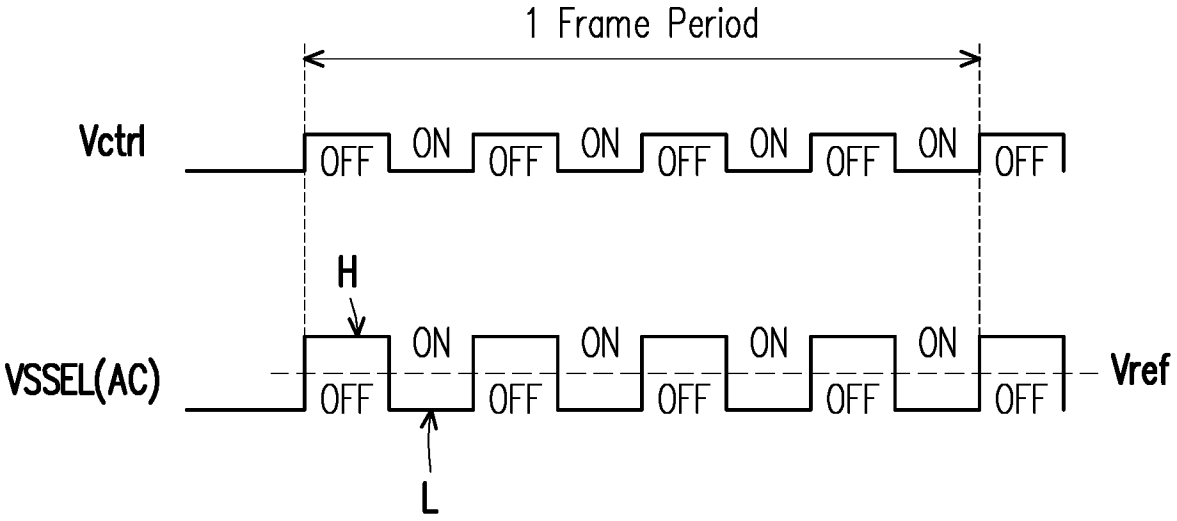
FIG. 3 illustrates a waveform diagram of the control signal and the second power signal depicted in FIG. 1.

To be specific, FIG. 2 illustrates a schematic diagram of the power management circuit depicted in FIG. 1. FIG. 3 illustrates a waveform diagram of the control signal and the second power signal depicted in FIG. 1. Referring to FIG. 2 and FIG. 3, the power management circuit 112 of the present embodiment includes a first switch 210, a second switch 220, a capacitor and an inverter 240.

The first switch 210 includes a first end, a second end and a control end. The first end of the first switch 210 is coupled to the first power signal VDDEL (a first voltage). The second end of the first switch 210 is coupled to the first end of the capacitor 230. The control end of the first switch 210 is coupled to the control signal Vctrl. The second switch 220 includes a first end, a second end and a control end. The first end of the second switch 220 is coupled to a second voltage VSSEL(DC). The second end of the second switch 220 is coupled to the first end of the capacitor 230. The control end of the second switch 220 is coupled to a reverse signal of the control signal Vctrl. The inverter 240 includes an input end and an output end. The input end of the inverter 240 receives the control signal Vctrl from the display driver device 120. The output end of the inverter 240 outputs the reverse signal of the control signal Vctrl to the control end of the second switch 220. In the present embodiment, the control signal Vctrl is a digital signal as shown in FIG. 3. The control signal Vctrl controls the conduction state of the first switch 210 and the second switch 220. When the first switch 210 is conducted, the second switch 220 is not conducted, and when the second switch 220 is conducted, the first switch 210 is not conducted.

The capacitor 230 includes a first end and a second end. The first end of the capacitor 230 is coupled to the second end of the first switch 210 and the second end of the second switch 220. The second end of the capacitor 230 is coupled to a reference voltage Vref. The power management circuit 112 outputs the second power signal VSSEL(AC) to the pixel circuit 132 via the second end of the capacitor 230.

Referring to FIG. 3, the levels of the second power signal VSSEL(AC) includes a first level H and a second level L in the present embodiment. The first level H and the second level L are respectively determined according to the reference voltage DC, the first power signal VDDEL and the second voltage VSSEL(DC). The first level H is higher than the second level L. In the present embodiment, the first level H may be obtained based on the formula H=DC level+[(VDDEL−VSSEL)/2], and the second level L may be obtained based on the formula L=DC level−[(VDDEL−VSSEL)/2], where DC level is the level value of the reference voltage Vref, VDDEL is the level value of the first power signal VDDEL, and VSSEL is the level value of the second voltage VSSEL(DC). In FIG. 3, the mark "OFF" indicates the OLED pixel 132 stays in an OFF period, and the mark "ON" indicates the OLED pixel 132 stays in an ON period.

In the present embodiment, the display driver device 120 controls the power management device 110 by using the control signal Vctrl, and the power management device 110 outputs the second power signal VSSEL(AC) of the AC format to the OLED pixel 132. By adjusting the duty cycle of the control signal Vctrl, the ON and OFF periods of the OLED pixel 132 are adjusted. For example, adjusting the duty cycle of the control signal Vctrl to 50% can reduce a half of power consumption of the OLED pixel 132. In addition, the power management device 110 can perform a reverse voltage operation on the OLED pixel 132 and adjust the level of the second power signal VSSEL(AC) by adjusting the level of the reference voltage Vref. By adjusting the level of the reference voltage Vref, a reverse voltage is provided during OFF period so as to initialize the OLED pixel 132 to an initial state.

Figure 4:
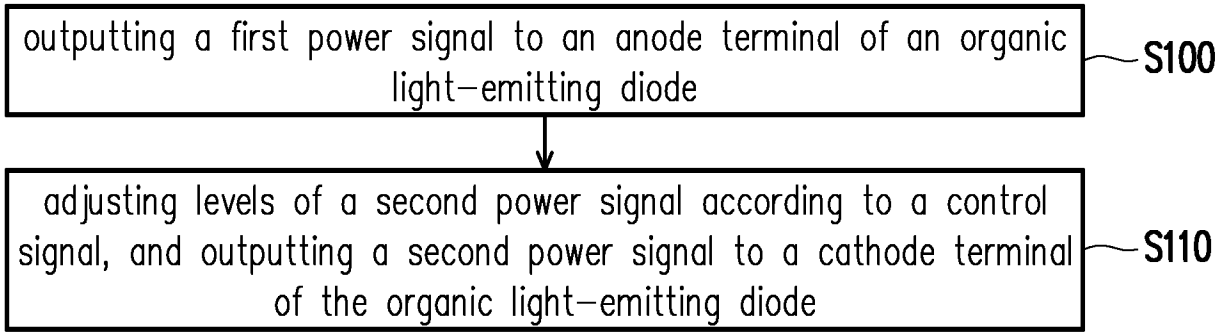
FIG. 4 is a flowchart illustrating steps in a power management method for a pixel circuit of a display panel according to an embodiment of the invention.

FIG. 4 is a flowchart illustrating steps in a power management method for a pixel circuit of a display panel according to an embodiment of the invention. Referring to FIG. 1 and FIG. 4, the power management method of the embodiment is at least adapted to the display apparatus 100 of FIG. 1, but the invention is not limited thereto. Taking the display apparatus 100 of FIG. 1 for example, in step S100, the power management device 110 outputs the first power signal VDDEL to the anode terminal of the organic light-emitting diode D. In step S110, the power management device 110 adjusts levels of a second power signal VSSEL(AC) according to a control signal Vctrl, and outputs the second power signal VSSEL(AC) to the cathode terminal of the organic light-emitting diode D, where the second power signal VSSEL(AC) is an alternating-current voltage. In addition, sufficient teaching, suggestion, and implementation illustration regarding the power management method of the embodiments of the disclosure may be obtained from the foregoing embodiments of FIG. 1 to FIG. 3, and thus related description thereof is not repeated hereinafter.

In summary, in exemplary embodiments of the invention, the power management device is control to output an AC voltage to control the OFF and ON periods of the OLED pixel, such that the power consumption of the OLED pixel, is reduced. In addition, the power management device provides a reverse voltage to initialize the OLED pixel to an initial state during the OFF period.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A power management device, comprising:

a power management circuit configured to output a first power signal and a second power signal to a pixel circuit of a display panel, wherein the pixel circuit comprises an organic light-emitting diode, the organic light-emitting diode comprises an anode terminal and a cathode terminal, the anode terminal is coupled to the first power signal, and the cathode terminal is coupled to the second power signal, wherein the second power signal is an alternating-current voltage, wherein levels of the second power signal are adjusted according to a control signal, wherein the levels of the second power signal comprises a first level and a second level, the first level and the second level are respectively determined according to a reference voltage, a first voltage and a second voltage, and the first level is higher than the second level, and wherein the first power signal is the first voltage.

2. The power management device of claim 1, wherein the power management circuit comprises: a first switch comprising a first end, a second end and a control end, wherein the first end of the first switch is coupled to the first voltage, and the control end of the first switch is coupled to the control signal; a second switch comprising a first end, a second end and a control end, wherein the first end of the second switch is coupled to the second voltage, and the control end of the second switch is coupled to a reverse signal of the control signal; and a capacitor comprising a first end and a second end, wherein the first end of the capacitor is coupled to the second end of the first switch and the second end of the second switch, and the second end of the capacitor is coupled to the reference voltage, wherein the power management circuit outputs the second power signal via the second end of the capacitor.

3. The power management device of claim 2, wherein the power management circuit further comprises: an inverter comprising an input end and an output end, wherein the input end of the inverter receives the control signal and the output end of the inverter outputs the reverse signal of the control signal.

4. The power management device of claim 2, wherein the control signal is a digital signal, when the first switch is conducted, the second switch is not conducted, and when the second switch is conducted, the first switch is not conducted.

5. The power management device of claim 1, wherein the power management circuit receives the control signal from a display driver device, and the display driver device outputs a scan signal and a data signal to the pixel circuit and outputs the control signal to the power management circuit.

6. The power management device of claim 1, wherein the first power signal is a direct-current voltage.

7. A pixel circuit of a display panel, comprising:

a first transistor comprising a first end, a second end and a control end, wherein the first end of the first transistor is coupled to a data line, and the control end of the first transistor is coupled to a scan line;

a second transistor comprising a first end, a second end and a control end, wherein the first end of the second transistor is coupled to a first power signal, and the control end of the second transistor is coupled to the second end of the first transistor;

an organic light-emitting diode comprising an anode terminal and a cathode terminal, wherein the anode terminal is coupled to the second end of the second transistor, and the cathode terminal is coupled to the second power signal; and a capacitor comprising a first end and a second end, wherein the first end of the capacitor is coupled to the first end of the second transistor, and the second end of the capacitor is coupled to the control end of the second transistor, wherein the second power signal is an alternating-current voltage, wherein levels of the second power signal are adjusted according to a control signal, wherein the levels of the second power signal comprises a first level and a second level, the first level and the second level are respectively determined according to a reference voltage, a first voltage and a second voltage, and the first level is higher than the second level, and wherein the first power signal is the first voltage.

8. The pixel circuit of claim 7, wherein the first power signal is a direct-current voltage.

9. A power management method for a pixel circuit of a display panel, wherein the pixel circuit comprises an organic light-emitting diode, and the organic light-emitting diode comprises an anode terminal and a cathode terminal, the power management method comprising:

outputting a first power signal to the anode terminal of the organic light-emitting diode;

adjusting levels of a second power signal according to a control signal; and outputting the second power signal to the cathode terminal of the organic light-emitting diode, wherein the second power signal is an alternating-current voltage, wherein the levels of the second power signal comprises a first level and a second level, the first level and the second level are respectively determined according to a reference voltage, a first voltage and a second voltage, and the first level is higher than the second level, and wherein the first power signal is the first voltage.

10. The power management method of claim 9, further comprising: receiving the control signal from a display driver device, wherein the display driver device outputs a scan signal and a data signal to the pixel circuit.

11. The power management method of claim 9, wherein the first power signal is a direct-current voltage.

12. A power management device, comprising:

a power management circuit, configured to output a first power signal and a second power signal to a pixel circuit of a display panel, comprising of:

a first switch comprising a first end, a second end and a control end, wherein the first end of the first switch is coupled to a first voltage, and the control end of the first switch is coupled to a control signal;

a second switch comprising a first end, a second end and a control end, wherein the first end of the second switch is coupled to a second voltage, and the control end of the second switch is coupled to a reverse signal of the control signal; and a capacitor comprising a first end and a second end, wherein the first end of the capacitor is coupled to the second end of the first switch and the second end of the second switch, and the second end of the capacitor is coupled to a reference voltage, wherein the power management circuit outputs the second power signal via the second end of the capacitor, wherein the pixel circuit comprises an organic light-emitting diode, the organic light-emitting diode comprises an anode terminal and a cathode terminal, the anode terminal is coupled to the first power signal, and the cathode terminal is coupled to the second power signal, and wherein the second power signal is an alternating-current voltage.

* * * * *